United States Patent [19]

Franke et al.

[11] Patent Number: 4,859,972

[45] Date of Patent: Aug. 22, 1989

[54] CONTINUOUS PHASE SHIFTER FOR A PHASED ARRAY HYPERTHERMIA SYSTEM

[75] Inventors: Steven J. Franke, Champaign; Ronald D. Boesch, Rockford; Richard L. Magin, Urbana, all of Ill.

[73] Assignee: The Board of Trustees of the University of Illinois, Urbana, Ill.

[21] Appl. No.: 265,499

[22] Filed: Nov. 1, 1988

[51] Int. Cl.[4] ..... H01P 1/185

[52] U.S. Cl. ..... 333/164; 333/161

[58] Field of Search ..... 333/156, 157, 160, 161, 333/164, 245, 246, 248

[56] References Cited

U.S. PATENT DOCUMENTS 3,768,045 10/1973 Chung ..... 333/164

*Primary Examiner*—Marvin L. Nussbaum

*Attorney, Agent, or Firm*—Philip P. Mann; Michael D. Rechtin

[57] ABSTRACT

A continuous microstrip phase shifter suitable for use in a phased array microwave hyperthermia system operating at 915 MHz is provided. The phase shifter utilizes a three dB quadrature hybrid coupler in conjunction with microstrip lines to change the phase of a transmitted wave. The phase change is introduced through the reflection ports of the coupler which are loaded with identical parallel resonant circuits. An abrupt junction varactor capacitance in parallel with a distributed inductance forms a voltage-tunable resonant circuit. The resonant element values are chosen to give a specified continuous phase variation with minimum transmission loss. This is accomplished without additional microwave circuit elements.

6 Claims, 1 Drawing Sheet

CONTINUOUS PHASE SHIFTER FOR A PHASED ARRAY HYPERTHERMIA SYSTEM

BACKGROUND OF THE INVENTION

This invention relates generally to microwave hyperthermia treatment systems and, more particularly, to a microwave phase shifter suitable for use in such systems.

Continuous microwave phase shifters utilizing variable reactive loads on the reflection ports of 3 decibel (dB) quadrature hybrid couplers are known in the art and have been utilized primarily as phase modulators. This application requires that the phase shifters provide a linear phase versus control voltage relationship, as well as broadband frequency response characteristics. The maintenance of a substantially uniform insertion or transmission loss over the range of available phase shift is, however, only of secondary concern.

In microwave hyperthermia treatment systems, which typically operate at a single fixed frequency, broadband frequency response characteristics are not required, nor is it required that a phase shifter used in such a system exhibit a linear phase versus control voltage response. Rather, a substantially uniform transmission loss over the range of available phase shift is the Primary design goal. Accordingly, phase shifters which are well suited for use as phase modulators are generally not as well suited for use in microwave hyperthermia treatment systems. Furthermore, such phase shifters are generally of greater complexity than is necessary for use in a microwave hyperthermia treatment system and can needlessly raise the cost of such a system.

In view of the foregoing, it is a general object of the present invention to provide a new and improved continuous microwave phase shifter.

It is a further object of the present invention to Provide a new and improved phase shifter which provides a substantially uniform transmission loss over the range of available phase shift and is thus well suited for use in a hyperthermia treatment system.

It is a still further object of the present invention to provide a continuous microwave phase shifter which can be manufactured with economy and ease.

SUMMARY OF THE INVENTION

The invention provides a continuous microwave phase shifter comprising a quadrature hybrid coupler having a pair of reflective ports and a pair of reactive loads coupled respectively to the reflective ports. Each of the reactive loads comprises a distributed inductance coupled to the reflective port and a varactor connected in parallel with the distributed inductance adjacent each reflective port.

In one embodiment, voltage control means are provided for applying a DC control voltage to each of the varactors.

In one embodiment, isolating means are provided for isolating the control voltage source at the operating frequency of the phase shifter.

In one embodiment, isolation is provided by means of shorted quarter-wavelength microstrip sections.

In one embodiment, each of the distributed inductances comprises a microstrip section.

In one embodiment, a shorting capacitor is provided across the terminal end of each microstrip section.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in the several figures of which like reference numerals identify like elements, and in which:

DESCRIPTION OF THE PREFERRED EMBODIMENT

Figure 1:
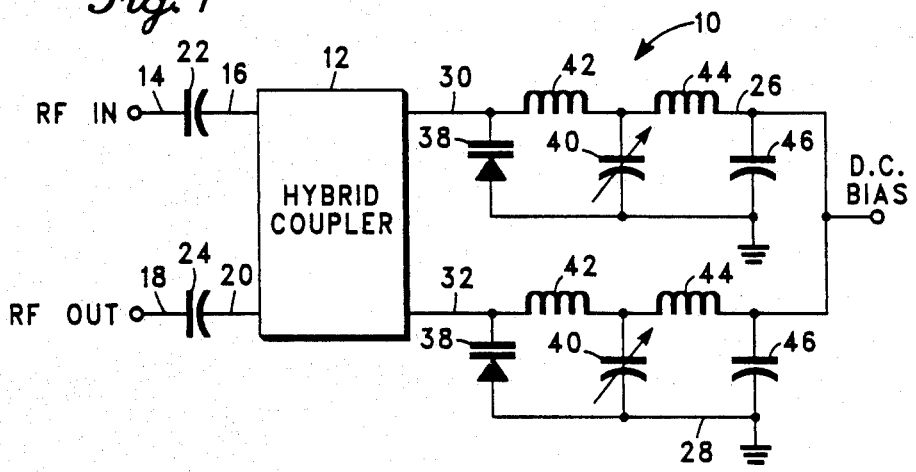
FIG. 1 is an electrical schematic diagram of a continuous microwave phase shifter embodying the invention.
Figure 2:
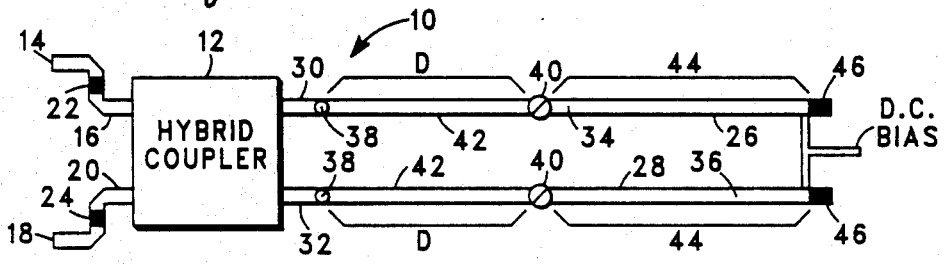
FIG. 2 is a diagramatic illustration of the continuous microwave phase shifter illustrated in FIG. 1.

A continuous microwave phase shifter 10 constructed in accordance with invention is illustrated in FIGS. 1 and 2. As shown, the continuous microwave phase shifter 10 is preferably implemented using microstrip technology such as that obtainable, for example, from 3M as "CC 250GX Dielectric Substrate." The phase shifter 10 includes a 3 dB quadrature hybrid coupler 12 such as that manufactured, for example, by Anaren under part number 1A0264-3.

As further illustrated, microwave energy is supplied to the phase shifter through an input port 14 electrically coupled to the input port 16 of the quadrature hybrid coupler 12. A variable DC bias or control voltage is applied to the phase shifter and phase-shifted microwave energy is returned from the phase shifter 10 through an output port 18 electrically coupled to the output port 20 of the hybrid coupler 12. The phase shift thus provided is controlled by the magnitude of the DC control voltage. Preferably, a series connected DC blocking capacitor 22, 24 is provided in each of the input and output ports 14, 18 of the phase shifter 10.

In accordance with one aspect of the invention, a reactive load 26,28 comprising a distributed inductance and an abrupt junction varactor capacitance is coupled to each of the two reflective ports 30, 32 of the quadrature hybrid coupler 12. Each reactive load 26, 28 forms a parallel resonant circuit, and the component values are chosen to minimize the transmission loss variation.

Referring further to FIGS. 1 and 2, each reactive load 26, 28 includes a length of microstrip forming a transmission line 34, 26 coupled to a reflecting port 30, 32 of the hybrid coupler. The abrupt junction varactor capacitance in each of the reactive loads comprises a varactor 38 inserted through each microstrip line 34, 36 as a parallel element adjacent each of the reflective Ports 30, 32. A variable shorting capacitor 40 is also mounted through each microstrip line 34, 36 at a location displaced from the varactor 38 by a distance D so as to form a segment 42 of length D. Each segment 42 of microstrip thus formed comprises a distributed parallel inductance. The distance D is dependent on the capacitance of the shorting capacitors 40 and is selected so as to place each of the reactive loads 26, 28 at or near resonance when the phase shifter 10 is operated at the desired operating frequency.

To ensure uniform "tracking" of the reactive loads 26, 28, "matched" varactors 38 should be used. In addition, care should be taken to construct loads that are identical and produce a high quality factor or "Q". To this end, low loss microwave dielectrics should be used.

In order to allow the DC control voltage to be applied to each varactor 38 without loading the reactive loads 26, 28, a shorted quarter-wavelength decoupling section 44 of microstrip extends beyond each of the shorting capacitors 40. Preferably, each quarter-wave section 44 compises an extension of each microstrip line 34, 36 beyond the variable shorting capacitors 40, and each extension 44 terminates in an additional shorting capacitor 46. The DC control voltage is applied to each of the quarter-wave sections 44 at the terminal ends thereof. Each quarter-wave section 44 thus serves to couple the DC control voltage to the varactors while electrically isolating the control voltage source from microwave engery at the system operating frequency.

In operation, the capacitances of the variable shorting capacitors 40 are adjusted to set the range of available phase shift. Preferably, this adjustment should be made at the anticipated operating power level of the phase shifter 10. Once the phase shift range is set, the varactors 38 can be biased by the DC control voltage so as to provide electronic control of the phase shift.

As stated earlier, the component values are chosen so as to realize a minimum variation in transmission loss for a specified phase shift. Preferably, the components are chosen through computer simulation utilizing an interactive optimization software routine that finds the minimum loss variation for a specified phase shift and frequency. One such interactive optimization software routine is described in the master's thesis of co-inventor, Ronald D. Boesch, entitled "Development of a Continuous Phase Shifter for a microwave Phased Array Hyperthermia System," submitted Dec. 10, 1986, to the graduate college of the University of Illinois, and incorporated by reference herein.

Figure 3:
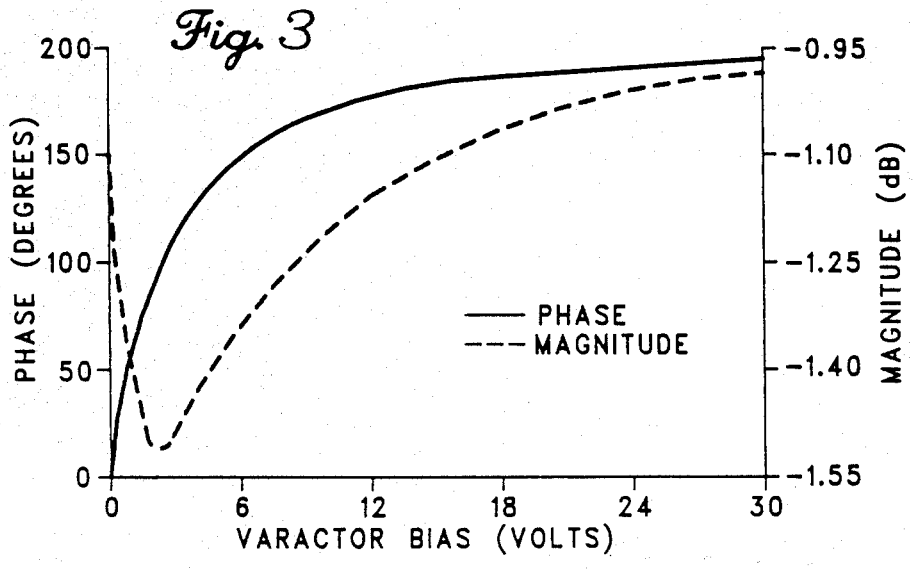
FIG. 3 is a graph showing the measured phase and amplitude responses of an example continuous microwave phase shifter constructed in accordance with the invention.

An example of the continuous microwave phase shifter embodying the invention described herein was designed and built to provide 180° of continuous phase variation at an operating frequency of 915 MHz. The selected varactors 38 (manufactured by Alpha Industries under part number DVH6732) provided a 4-volt capacitance of 3.9 pF, and the distributed inductance of each microstrip line 34, 36 over the distance D was 7.9 nH. Each of the variable shorting capacitors 40 comprised a screw turn shorting capacitor 22, 24 (manufactured by Johanson under part number SL27271), and 33 pF DC blocking capacitors 14, 18 (manufactured by Republic Electronics under part number O13Q330GU) were included in the inputs and outputs 14, 18 of the Hybrid coupler 12. Each of the quarter-wave decoupling lines 44 terminated in a 1,000 pF shorting capacitor 46 manufactured by Republic Electronics under part number O13Q102GU. The phase and amplitude responses of the phase shifter 10 as so constructed, are shown in FIG. 3.

The phase shifter 10 as shown and described herein provides several advantages over previously known circuits. The phase shifter 10 can be easily fabricated using commercial components in a facility not primarily prepared to build microwave integrated circuits or monolithic microwave integrated circuits. The variable capacitors 40 used for inductance tuning make the phase shift range easy to set with a screwdriver and a vector volt meter or network analyzer. Furthermore, the phase shifter 10 is easily realized using only two RF components for the variable reflective load.

Modifications to the circuit implementation of the phase shifter shown and described herein can be made. For example, the variable shorting capacitors 40 used for inductance tuning can be modified by, for example, placing capacitive squares beside each transmission line. Wire bands from one of these squares could be used to position the ideal short. Additionally, the quarter-wave decoupling lines 44 can be moved, and the dielectric substrate can be changed to reduce or expand the physical size of the circuit. Finally, a metal enclosure can be placed around the circuit to confine electromagnetic radiation.

While a particular embodiment of the invention has been shown and described, it will be obvious to those skilled in the art the changes and modifications may be made without departing from the invention in its broader aspects, and, therefore, the aim in the appended claims is to cover all such changes and modifications as fall within the true spirit and scope of the invention.

We claim:

1. A continuous microwave phase shifter comprising:

a quadrature hybrid coupler having a pair of reflective ports; and a pair of reactive loads coupled respectively to said reflective ports, each of said reactive loads comprising:

a distributed inductance coupled to said reflective port; and a varactor connected in parallel with said distributed inductance adjacent said reflective port.

2. A continuous microwave phase shifter as defined in claim 1 further comprising control means for applying a DC voltage to each of said varactors so as to controllably vary the capacitance of each of said varactors.

3. A continuous microwave phase shifter as defined in claim 2 wherein each of said distributed inductances comprises a microstrip segment of fixed length.

4. A continuous microwave phase shifter as defined in claim 3 wherein each microstrip segment of fixed length terminates in a shorting capacitor.

5. A continuous microwave phase shifter in accordance with claim 4 wherein said phase shifter is operable at a fixed operating frequency and wherein said phase shifter further comprises means for electrically isolating said DC control voltage means from said microstrip segments at said operating frequency.

6. A continuous microwave phase shifter as defined in claim 5 wherein said isolating means comprises a pair of quarter-wavelength shorted segments of microstrip coupled to said fixed length segments of microstrip.

* * * * *